US009805896B2

(12) United States Patent
Bianco et al.

(10) Patent No.: US 9,805,896 B2
(45) Date of Patent: Oct. 31, 2017

(54) MECHANICALLY OPERATED SWITCHING DEVICE AND RELATED SWITCHGEAR HAVING A MOVABLE MEMBER FOR OPERATING THE SWITCHING DEVICE

(71) Applicant: ABB Technology AG, Zürich (CH)

(72) Inventors: Andrea Bianco, Sesto San Giovanni (IT); Gabriele Valentino De Natale, Milan (IT)

(73) Assignee: ABB Schweiz AG, Baden (CH)

( * ) Notice: Subject to any disclaimer, the term of this patent is extended or adjusted under 35 U.S.C. 154(b) by 276 days.

(21) Appl. No.: 14/245,820

(22) Filed: Apr. 4, 2014

(65) Prior Publication Data

US 2014/0218138 A1 Aug. 7, 2014

Related U.S. Application Data

(63) Continuation of application No. PCT/EP2012/067451, filed on Sep. 6, 2012.

(30) Foreign Application Priority Data

Oct. 6, 2011 (EP) ..... 11184077

(51) Int. Cl.
*H01H 71/24* (2006.01)
*H01H 3/30* (2006.01)
*H01H 83/12* (2006.01)

(52) U.S. Cl.
CPC ..... *H01H 71/2454* (2013.01); *H01H 3/3052* (2013.01); *H01H 83/12* (2013.01); *H01H 2003/3089* (2013.01)

(58) Field of Classification Search
CPC ..... H01H 3/3052; H01H 71/2454; H01H 2003/3089; H01H 83/12
(Continued)

(56) References Cited

U.S. PATENT DOCUMENTS 3,524,084 A * 8/1970 Horan ..... F02P 3/12 123/642
4,876,521 A * 10/1989 Boyd ..... H01H 71/322 335/179

(Continued)

FOREIGN PATENT DOCUMENTS

WO 2000-294092 A 10/2000
WO WO 2011/041482 A1 4/2011

OTHER PUBLICATIONS

International Search Report (PCT/ISA/210) dated Dec. 12, 2012, by the European Patent Office as the International Searching Authority for International Application No. PCT/EP2012/067448.

(Continued)

*Primary Examiner* — Bernard Rojas
(74) *Attorney, Agent, or Firm* — Taft Stettinius & Hollister LLP

(57) ABSTRACT

An exemplary mechanically operated switching device includes at least one movable contact and an operating mechanism for coupling/separating the movable contact to/from a corresponding fixed contact. The operating mechanism includes first elastic mechanism for, upon release, providing the energy to separate the movable and fixed contacts. At least one shunt release having: a member movable between first and second stable positions, wherein movement from the first stable position to the second stable position releases the first elastic mechanism; at least a permanent magnet generating a force for holding the movable member in the first stable position, wherein the movable member held in the first stable position compresses a second elastic mechanism; and at least one electrical winding associated with the movable member and the electronic mechanism, which is configured to electrically drive the winding (Continued)

to generate a magnetic force that releases of the compressed second elastic mechanism.

20 Claims, 4 Drawing Sheets

(58) Field of Classification Search
USPC ..... 335/12, 177–184
See application file for complete search history.

(56) References Cited

U.S. PATENT DOCUMENTS

| | | | | |
|---|---|---|---|---|
| 5,797,360 | A * | 8/1998 | Pischinger | F01L 9/04 123/90.11 |
| 6,246,562 | B1 * | 6/2001 | Durif | H01H 47/002 361/154 |
| 2002/0021540 | A1 | 2/2002 | Opfer et al. | |
| 2002/0158727 | A1 * | 10/2002 | Namen | E05B 47/00 335/78 |
| 2004/0217834 | A1 * | 11/2004 | Morita | H01F 7/1615 335/220 |
| 2005/0225909 | A1 | 10/2005 | Yoshizaki et al. | |
| 2011/0080685 | A1 | 4/2011 | Wellner et al. | |
| 2014/0218838 | A1 * | 8/2014 | Mannino | H01H 47/002 361/160 |

OTHER PUBLICATIONS

Written Opinion (PCT/ISA/237) dated Dec. 12, 2012, by the European Patent Office as the International Searching Authority for International Application No. PCT/EP2012/067448.

International Search Report (PCT/ISA/210) dated Nov. 21, 2012, by the European Patent Office as the International Searching Authority for International Application No. PCT/EP2012/067451.

Written Opinion (PCT/ISA/237) dated Nov. 21, 2012, by the European Patent Office as the International Searching Authority for International Application No. PCT/EP2012/067451.

* cited by examiner

MECHANICALLY OPERATED SWITCHING DEVICE AND RELATED SWITCHGEAR HAVING A MOVABLE MEMBER FOR OPERATING THE SWITCHING DEVICE

RELATED APPLICATION

This application claims priority as a continuation application under 35 U.S.C. §120 to PCT/EP2012/067451, which was filed as an International Application on Sep. 6, 2012 designating the U.S., and which claims priority to European Application 11184077.3 filed in Europe on Oct. 6, 2011. The content of each prior application is hereby incorporated by reference in its entirety.

FIELD

The present disclosure relates to a switching device, and particularly to a mechanically operated switching device.

BACKGROUND INFORMATION

Known switching devices used in electrical circuits, such as in low or medium voltage electric circuits, such as circuit breakers, disconnectors and contactors, which are devices designed to allow the correct operation of specific parts of the electric circuits in which they are installed, and of the associated electric loads. For purposes of the present disclosure, the term "low voltage" is referred to applications with operating voltages up to 1000V AC/1500V DC and the term "medium voltage" is referred to applications in the range from 1 kV to some tens of kV, e.g. 50 kV.

The switching devices include one or more electrical poles, or phases, each having at least a movable contact and a corresponding fixed contact. An operating mechanism is operatively associated to the movable contacts to cause the movement of such contacts between a first closed position in which they are mechanically coupled to the corresponding fixed contacts (e.g., closed switching device) and a second open position in which they are spaced away from the corresponding fixed contacts (e.g., open switching device).

Mechanically operated switching devices include an operating mechanism of the "stored-energy" type, e.g., an operating mechanism having elastic means, such as a pair of springs, which are compressed to store the energy specified for displacing the movable contacts from the closed position to the open position.

Several shunt releases and/or accessories can be operatively associated to the stored-energy operating mechanism; use of such shunt releases and/or accessories is to release or lock one or more mechanical parts of the associated operating mechanism. For example, shunt opening releases can be arranged to act on the operating mechanism to cause the release of its compressed elastic means, following an open or trip command.

FIG. 1 illustrates a mechanically operated tri-polar switching device 500 of a known implementation. The switching device 500 has an operating mechanism 10 operatively connected to the three movable contacts 3 of the poles 2 to cause the coupling/separation of such contacts 3 to/from the corresponding fixed contacts The operating mechanism 10 can include, for example, a pair of springs 11 to provide the energy specified to open the switching device 500.

The known switching device 500 of FIG. 1 includes: an opening shunt release 5 configured for causing the opening of the switching device 500 upon receiving a shunt trip command; an under-voltage shunt release 6 configured for causing the opening of the switching device 500 and/or locking the opened switching device 500 upon the detection of an under-voltage condition; a closure shunt release 7 configured for causing the closure of the switching device 500 upon receiving a closure command; and a locking magnet 8 which is configured to lock the operating mechanism 10 and block the closure of the switching device 500.

Further, a redundant opening shunt release may be provided, having substantially the same functionalities of the opening shunt release 5.

The shunt opening release 5 and the under-voltage shunt release 6 each includes an electrical winding operatively associated to an armature movable between a first attracted position and a second released position, wherein the movement from the attracted to the released position causes the intervention of the armature on one or more parts of the operating mechanism 10 to open the switching device 500.

The shunt trip command can cause the application of power supply to the winding of the opening shunt release 5, to generate a magnetic force moving the armature from the retracted position the released position.

The armature of the under-voltage shunt release 6 in the retracted position compresses a spring and it is held in such retracted position by a magnetic force generated by continuously energizing the winding with an auxiliary power supply. Because of the under-voltage condition occurrence, the auxiliary power supply at least reduces in such a way that the compressed spring releases and urges the armature towards the released position.

One or more additional accessories 80, 9 may be associated with the under-voltage shunt release 6. For example, some applications of the switching device 500 specify a delay time between the occurrence of an under-voltage condition and the consequent intervention of the under-voltage shunt release 6 to open the switching device 500. The energy specified to hold the armature of the under-voltage shunt release 6 in the retracted position during the delay time is provided by means of one or more external capacitors 9, which are for example connected between the auxiliary power supply and the winding of the under-voltage shunt release 6.

Further, in some applications of the switching device 500 can be called on to provisionally disable the opening and/or locking functionality of the under-voltage shunt release 6 upon the occurrence of an under-voltage condition. A mechanical override device 80 can be operatively coupled to the under-voltage release 6 to mechanically block, when activated by an operator, the armature of the undervoltage release 6 in the retracted position, even if an under-voltage condition has occurred.

At the current state of the art, although known solutions perform in a rather satisfying way, there is still reason and desire for further improvements.

SUMMARY

An exemplary mechanically operated switching device is disclosed comprising: at least one movable contact configured to be coupled to and separated from a corresponding fixed contact; an operating mechanism configured for coupling and separating said movable contact to and from the corresponding fixed contact, wherein said operating mechanism includes first elastic means for, upon release, providing energy to separate said movable contact from the corresponding fixed contact; and at least one shunt release having: a member movable disposed between a first stable position and a second stable position, wherein the movement from the first stable position to the second stable position causes the operative interaction between said movable member and one or more parts of the operating mechanism to release said first elastic means; second elastic means which are connected to said movable member; at least a permanent magnet generating a holding force for holding the movable member in the first position, wherein the movable member held in the first stable position is configured for compressing said second elastic means; and at least one electrical winding which is connected to the movable member and to electronic means, wherein said electronic means are configured for electrically driving the winding to generate a first magnetic force acting on the movable member held in the first stable position, said first magnetic force releases the compressed second elastic means to urge the movable member towards the second stable position.

An exemplary mechanically operated switching device is disclosed comprising: at least one movable contact configured to be coupled to and separated from a corresponding fixed contact; an operating mechanism configured for coupling and separating said movable contact to and from the corresponding fixed contact, wherein said operating mechanism includes first elastic means for providing energy to separate said movable contact from the corresponding fixed contact; and at least one shunt release having: a member movable disposed between a first position and a second position, wherein the movement from the first position to the second position releases said first elastic means to separate said movable contact from the corresponding fixed contact; second elastic means which are connected to said movable member; at least a permanent magnet generating a holding force for holding the movable member in the first position; and at least one electrical winding which is connected to the movable member and to electronic means, wherein said electronic means are configured for electrically driving the winding to generate a first magnetic force acting on the movable member held in the first position to urge the movable member towards the second stable position.

DESCRIPTION OF THE DRAWINGS

Further characteristics and advantages of the invention will be more apparent from the description of exemplary, but non-exclusive, embodiments of the switching device according to the present disclosure, illustrated in the accompanying drawings, wherein.

Figure 1:
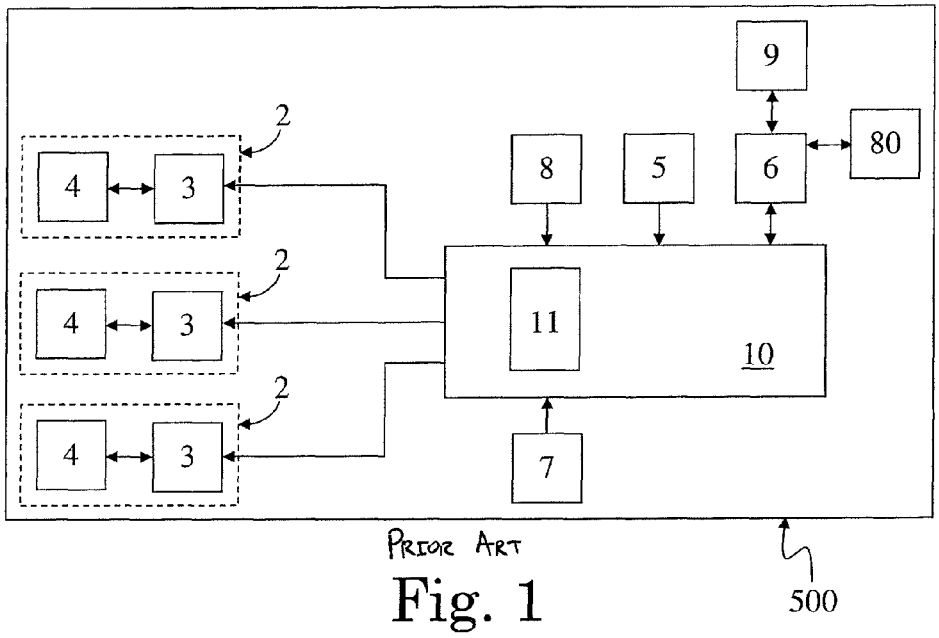
PRIOR ART Fig. 1
FIG. 1 illustrates a mechanically operated tri-polar switching device 500 of a known implementation.

It should be noted that in the detailed description that follows, identical or similar components, either from a structural and/or functional point of view, have the same reference numerals, regardless of whether they are shown in different embodiments of the present disclosure; it should also be noted that in order to clearly and concisely describe the present disclosure, the drawings may not be to scale and certain features of the disclosure may be shown in somewhat schematic form.

DETAILED DESCRIPTION

Exemplary embodiments of the present disclosure provide a mechanically operated switching device including: at least a movable contact couplable/separable (e.g., which can be coupled/separated) to/from a corresponding fixed contact; an operating mechanism operatively associated to the movable contact for coupling/separating such movable contact to/from the corresponding fixed contact, wherein the operating mechanism includes first elastic means which are suitable for providing with their release the energy to separate the movable contact from the corresponding fixed contact; and at least a shunt release.

The shunt release having: a member movable between a first stable position and a second stable position, wherein the movement from the first stable position to the second stable position causes the operative interaction between the movable member and one or more parts of the operating mechanism to release the first elastic means; second elastic means which are operatively associated to the movable member; at least a permanent magnet generating a holding force which is suitable for holding the movable member in the first stable position, wherein the movable member held in the first stable position is configured for compressing the second elastic means; and at least an electrical winding which is operatively associated to the movable member and to electronic means, wherein the electronic means are configured for electrically driving the winding to generate a first magnetic force acting on the movable member held in the first stable position, such first magnetic force being suitable for causing the release of the compressed second elastic means which urge the movable member towards the second stable position.

Another aspect of the present disclosure is to provide a switchgear including at least a switching device such as the switching device defined by the annexed claims and disclosed in the following description.

According to exemplary embodiments of the present disclosure, the exemplary switching device can be described by making reference to its embodiment as a mechanically operated circuit breaker; such an embodiment has to be understood only as an illustrative and non-limiting example since the principles and technical solutions introduced in the following description can be applied to other types of switching devices having an operating mechanism of the stored-energy type, such as for example disconnectors or contactors.

Figure 2:
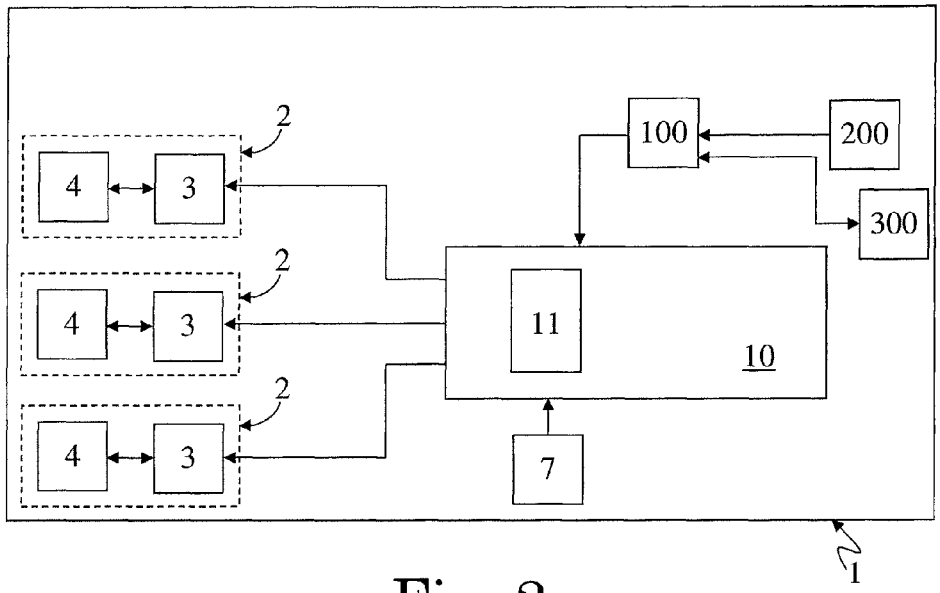
FIG. 2 shows a block diagram illustrating a mechanically operated circuit breaker with an associated shunt release according to an exemplary embodiment of the present disclosure.

FIG. 2 shows a block diagram illustrating a mechanically operated circuit breaker with an associated shunt release according to an exemplary embodiment of the present disclosure.

The circuit breaker 1 has for example three electric poles or phases 2; the principles and technical solutions that will be introduced in the following description are intended to be applicable also to a circuit breaker 1 with a number of poles 2 different from the illustrated one, such as for example a monophase circuit breaker 1, or a circuit breaker 1 with two or four poles 2.

Each pole 2 of the circuit breaker 1 includes at least a movable contact 3 couplable/separable (e.g., coupled/separated) to/from a corresponding fixed contact 4. A stored-energy type operating mechanism 10 is operatively connected to at least a movable contact 3 for coupling/separating the movable contact 3 to/from the corresponding fixed contact 4. The coupling and separation operation between the movable and fixed contacts 3, 4 cause the closing and the opening of the circuit breaker 1, respectively, and realizes or interrupts a flowing current path through the poles 2.

The operating mechanism 10 can include elastic means 11, for example, a pair of springs 11, which are suitable for being compressed to store a determined amount of potential energy, and for releasing such stored energy to open the circuit breaker 1, e.g., to cause the separation of the movable contacts 3 from the corresponding fixed contacts 4. Such operating mechanism 10 is of a known type, and therefore will not be disclosed in more detail.

Figure 3:
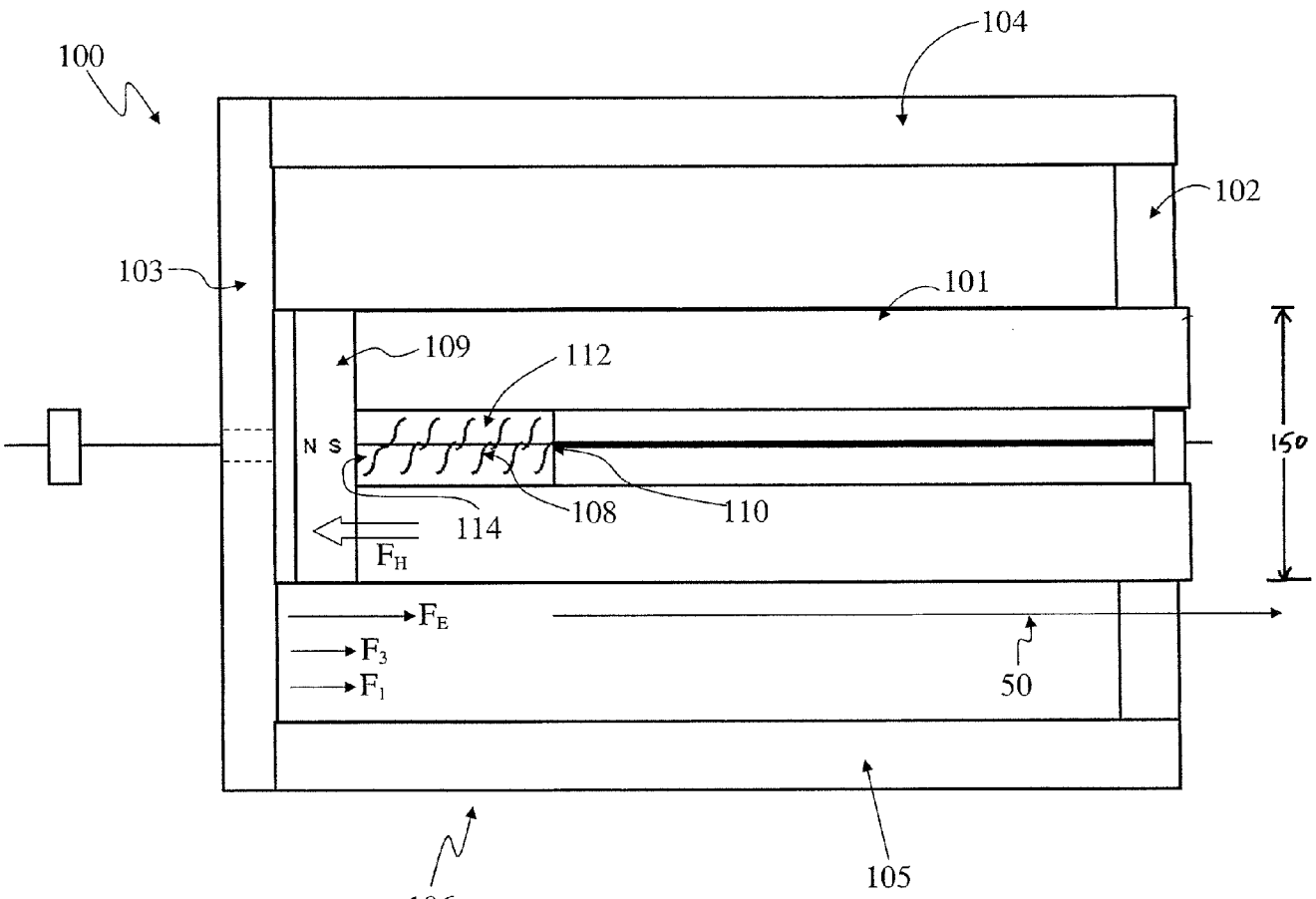
FIG. 3 is a sectional view of a shunt release, which has a movable member in a retracted position, used in a switching device according to an exemplary embodiment of the present disclosure.
Figure 4:
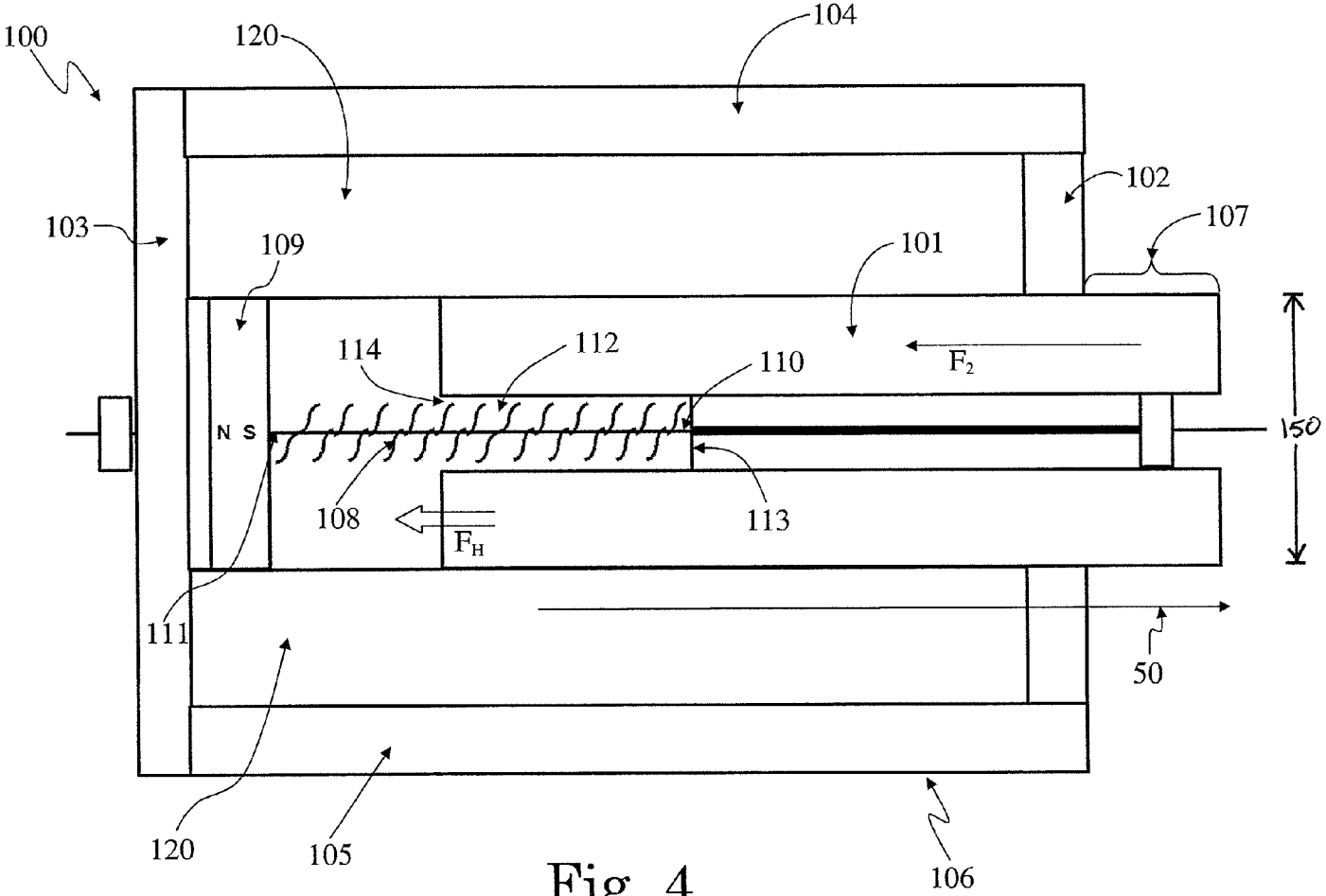
FIG. 4 is a sectional view a shunt release, which has a movable member in a released position, used in a switching device according to an exemplary embodiment of the present disclosure.

FIG. 3 is a sectional view of a shunt release, which has a movable member in a retracted position, used in a switching device according to an exemplary embodiment of the present disclosure; and FIG. 4 is a sectional view a shunt release, which has a movable member in a released position, used in a switching device according to an exemplary embodiment of the present disclosure.

According to the exemplary embodiments illustrated in FIGS. 3 and 4, the shunt release 100 includes a case 106 defined by front and rear walls 102, 103 and lateral walls extending between such front and rear walls 102, 103 (only two of which are viewable in the exemplary embodiment of FIGS. 3 and 4 and indicated by numeral references 104, 105).

A member 101, made for example of ferromagnetic material, is operatively associated to the case of 106 of the shunt release 100 so that it is movable between at least a first stable position, or retracted position, wherein the movable member 101 is housed within the case 106 (see FIG. 3), and a second stable position, or released position, wherein at least a portion 107 of the movable member 101 extends outside the case 106 (see FIG. 4).

The movement from the retracted to the released position can be suitable for causing operative interaction between the portion 107 of the movable member 101 and one or more parts of the operating mechanism 10 to release the compressed elastic means 11 of the operating mechanism 10 itself and cause the opening of the circuit breaker 1.

The shunt release 100 according to the present disclosure includes elastic means 108, such as for example one or more springs 108, which are operatively associated to the movable member 101; the shunt release 100 further includes at least a permanent magnet 109 generating a holding force $F_H$ acting on and suitable for holding the movable member 101 in the retracted position, wherein the movable member 101 held in the retracted position is configured to compress the associated elastic means 108.

The holding force $F_H$ is calibrated to hold the movable member 101 in the retracted position considering the mechanical tolerance of the magnetic circuit generated into the shunt release 100 and fundamental operative conditions of the circuit breaker 1.

Figure 5:
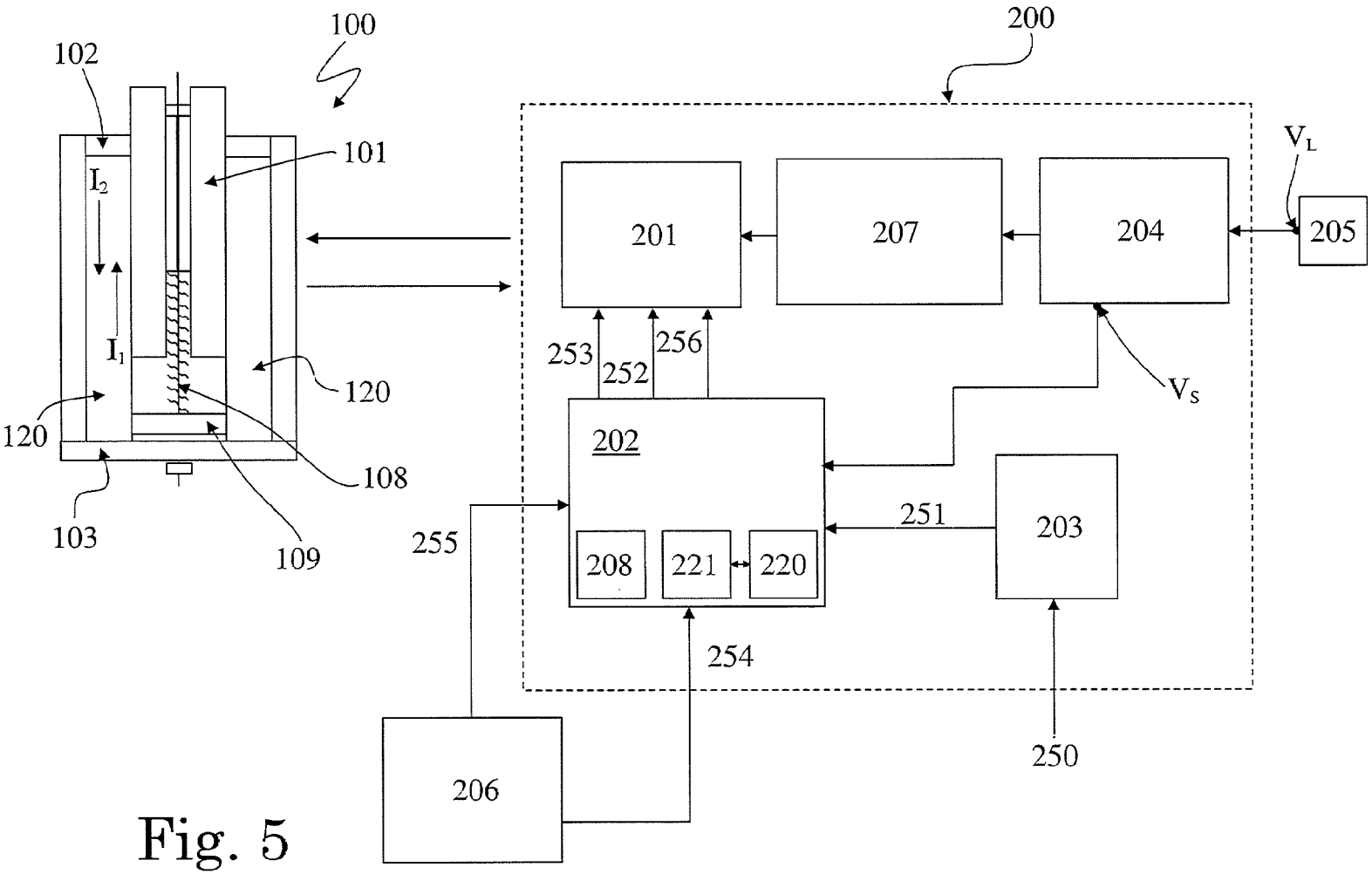
FIG. 5 shows a block diagram schematically depicting electronic means associated with a shunt release used in a switching device according to an exemplary embodiment of the present disclosure.

FIG. 5 shows a block diagram schematically depicting electronic means associated with a shunt release used in a switching device according to an exemplary embodiment of the present disclosure.

According to the exemplary embodiments of FIGS. 3-5, the movable member 101 is a plunger that can be movable in an internal space of the case 106 along a longitudinal axis 50 that is transverse to the rear and front walls 103, 102 of the shunt release 100. An opening 150 is defined in the front wall 102 to allow the passage therethrough of the portion 107 of the plunger 101 during its displacement between the retracted and released positions.

A spring 108 is placed into the case 106 of the shunt release 100 and has a first end 110 which abuts against the plunger 101. In FIGS. 3 and 4, a recess 112 is defined within the body of the plunger 101; such recess 112 has an access opening 114 and a base wall 113 which are transversal to the axis 50 and which face the rear wall 103 of the shunt release 100. The first end 110 of the spring 108 abuts against the base wall 113 of the recess 112.

The second end 111 of the spring 108 abuts against the permanent magnet 109 coupled to the rear wall 102 and generating the holding force $F_H$ which, as shown in FIGS. 3 and 4, is directed toward the rear wall 103.

The holding force $F_H$ generated by the permanent magnet 109 acts on and is suitable for holding the plunger 101 in the retracted position as shown in FIG. 3; the plunger 101 in the retracted position rests against the permanent magnet 109 and the recess 112 houses the compressed spring 108. The compressed spring 108 exerts an elastic force $F_E$ acting on the plunger 101 and directed towards the front wall 102 of the shunt release 100; therefore, the holding force $F_H$ generated by the permanent magnet 109 has to be strong enough to overcome the elastic force $F_E$ and hold the plunger 101 in the retracted position.

According to another exemplary embodiment of FIGS. 3 and 4, the permanent magnet 109 may be placed on the plunger 101 to generate the holding force $F_H$ directed towards the rear wall 103; for example, the permanent magnet 109 may be placed on the plunger 101 at the access opening 114 of the recess 112.

The shunt release 100 according to the present disclosure includes at least an electrical winding 120 operatively associated to the movable member 101; the winding 120 is placed within the case 106 of the shunt release 100 to be wound around the internal space provided for the movable member 101. In the exemplary embodiment of FIGS. 3 and 4 the winding 120 extends between the front and rear walls 102, 103 to be wound around the permanent magnet 109 and the whole body of the plunger 101 in the retracted position.

The winding 120 is operatively associated to electronic means 200 which are configured for electrically driving such winding 120 to generate a first magnetic force $F_1$ which acts on the movable member 101 in a direction opposed with respect to the holding force $F_H$. The first magnetic force $F_1$ is suitable for causing the release of the compressed elastic means 108 which urge the movable member 101 from the retracted position towards the released position.

The force given by the sum of forces $F_E$ and $F_1$ has to be strong enough to overcome the holding force $F_H$ and start the displacement of movable member 101 towards the released position.

The holding force $F_H$ strongly decreases as the displacement of the movable member 101 from the retracted position increases; the electronic means 200 are configured to drive the winding 120 and generate the first magnetic force $F_1$ until the decreasing holding force $F_H$ is overcome by the elastic force $F_E$. When the elastic force $F_E$ overcomes the decreasing holding force $F_H$ the elastic means 108 release and urge the movable member 101 towards the released position.

In practice, the electronic means 200 causes the generation of the first magnetic force $F_1$ to neutralize the effect of the permanent magnet 109 and to cause the displacement of the movable member 101 from the stable retracted position.

The movable member 101 is held in the released position by the elastic means 108, because the holding force $F_H$ still generated by the permanent magnet 109 is not strong enough to compress the elastic means 108 and cause the return of the movable member 101 in the retracted position According to an exemplary embodiment, the electronic means 200 are configured for electrically driving the associated winding 120 of the shunt release 100 so as to generated a second magnetic force $F_2$ acting on the movable member 101 in the released position and having the same direction of the holding force $F_H$ generated by the permanent magnet 109. Such second magnetic force $F_2$ is suitable for displacing the movable member 101 from the released position to the retracted position; the magnetic force $F_2$ has to be strong enough to cause the compression of the elastic means 108 by means of the displacement of the movable member 101.

FIG. 5 illustrates electronic means 200 in accordance with an exemplary embodiment of the present disclosure. The electronic means 200 includes a driving circuit 201 electrically connected to the winding 120 of the shunt release 1 and configured for generating a first current $I_1$ flowing through the winding 120. The flowing of the first current $I_1$ through the winding 120 generates the first magnetic force $F_1$ which causes the release of the elastic means 108.

The driving circuit 201 can be controlled by a controller 202 operatively connected thereto. In accordance with exemplary embodiments provided herein, the controller 202 can be any suitable electronic device arranged to: receive data, parameters, signals, and instructions; execute the instructions; and generate signals based on the execution of the instructions. For example, the controller 202 can be a microprocessor.

The controller 202 controls the driving circuit 201 such that the first current $I_1$ is a current pulse having a time duration long enough to allow the holding force $F_H$ to be overcome by the elastic force $F_E$; the current pulse $I_1$ has for example a time duration of some tens of milliseconds, e.g., 10 ms.

The driving circuit 201 can also be configured for generating a second current $I_2$ flowing through the winding 120 (see FIG. 3) in a direction opposite to the first current $I_1$ to generate the second magnetic force $F_2$ causing the return of the movable member 101 from the released position to the retracted position. For example, the driving circuit 201 may be an H-bridge electronic circuit 201 which is well known in the art and therefore not disclosed therein, wherein the transistors of such H-bridge electronic circuit can be electrically controlled by the controller 202.

The controller 202 can be operatively connected to suitable communication means 206 and be configured for receiving one or more configurable parameters and/or commands through such communication means 206, some of which will be introduced and disclosed in the following description.

The electronic means 200 can include a power supply input circuit 204 configured for receiving a power supply drawn from a power line 205 associated to the circuit breaker 1 and for adapting the drawn power to supply at least the controller 202 and the driving circuit 201.

The exemplary shunt release 100 of the present disclosure can be configured for implementing a shunt opening functionality, e.g., to cause the opening of the associated circuit breaker 1 upon receiving shunt opening, or trip, signals and/or commands. The electronic means 200 of the shunt release 100 according to such embodiments are configured for: receiving and detecting at least one shunt trip command (e.g., indicated in the example of FIG. 5 with the numeral reference 250) that calls for opening the circuit breaker 1; and electrically driving the winding 120 of the shunt release 100 to generate the first magnetic force $F_1$ upon the detection of such shunt trip command 250. The shunt trip command 250 can be sent to the circuit breaker 1 by remote or can be generated internally to the circuit breaker 1, for example by a protection unit of such circuit breaker 1.

The exemplary shunt release 100 according to the present disclosure can be configured for implementing a functionality of intervention upon the occurrence of an under-voltage condition in the electrical circuit into which the circuit breaker 1 is installed. The exemplary electronic means 200 of the shunt release 100 according to an exemplary embodiment disclosed herein are configured for detecting an under-voltage condition, e.g., a condition determined by a line voltage associated to the circuit breaker 1 falling below a predetermined threshold. The electronic means 200 can be configured for electrically driving the winding 120 of the associated shunt release 100 and generating the first magnetic force $F_1$ upon the detection of the under-voltage condition.

As shown in FIG. 5, the shunt release 100 can be configured for implementing both the shunt opening functionality and the intervention against under-voltage occurrence. The electronic means 200 of the shunt release 100 according to an exemplary embodiment can be configured for: receiving and detecting the shunt trip command 250 that specifies the opening of the circuit breaker 1 and electrically driving the winding 120 to generate the first magnetic force $F_1$ upon the detection of such shunt trip command 250; and detecting the under-voltage condition and electrically driving the winding 120 to generate the first magnetic force $F_1$ upon the detection of the under-voltage condition.

In FIG. 5, the electronic means 200 includes a receiving circuit 203, for example, a binary input 203 of the type known in the art, which is operatively connected to the controller 202. The receiving circuit 203 is arranged for receiving and detecting the shunt trip command 250 and consequently outputting at least a trip signal (e.g., indicated in FIG. 5 with the numeral reference 251) which is sent to the controller 202 to a corresponding input port of such controller 202.

The controller 202 can be configured for detecting the presence of an input of the trip signals 251 and for outputting one or more control signals (globally indicated in FIG. 5 with the numeral reference 252); such control signals 252 can be sent to and control the driving circuit 201 to cause the generation of the first current $I_1$ into the winding 120.

According to another exemplary embodiment disclosed herein, the functionality of receiving and detecting the shunt trip command 250 can be directly implemented into the controller 202, by executing suitable software instructions.

The controller 202 of FIG. 5 can also be electrically connected to the power supply input circuit 204 to sense a voltage $V_S$ indicative of the power line 205, such as the line voltage $V_L$ associated to such power line 205. According to another exemplary embodiment, the controller 202 can be electrically connected directly to the power line 205 to directly sense the line voltage $V_L$, or may be electrically connected to one or more other components of the electronic means 200 which are supplied by the power supply input circuit 204 and which have an associated voltage indicative of the line voltage $V_L$.

The controller 202 can be configured for continuously monitoring the sensed voltage $V_S$ to detect the occurrence of the under-voltage condition; for example, the under-voltage condition is detected when the sensed voltage $V_S$ falls below a predetermined threshold. In accordance with an exemplary embodiment of the present disclosure, the predetermined threshold is configurable by an operator, for example through the communication means 206.

The controller 202 can be configured for outputting, upon the detection of the under-voltage condition, one or more control signals (globally indicated in FIG. 5 with the numeral reference 253); such control signals 253 are sent to and control the driving circuit 201 to generate the first current $I_1$ into the winding 120 of the shunt release 100.

According to another exemplary embodiment of the present disclosure, the under-voltage detection can be implemented externally to the controller 202, through a suitable under-voltage detection circuit electrically connected to the controller 202. For example, an under-voltage detection circuit may be electrically connected to the power input circuit 204 to sense the voltage $V_S$; such under-voltage detection circuit includes a comparator arranged for comparing the sensed voltage $V_S$ to a predetermined threshold; when the sensed voltage $V_S$ falls below the threshold, an under-voltage signal is outputted by the under-voltage detection circuit and sent to the controller 202, for example, to a corresponding input port of the controller 202. The controller 202 can be configured for detecting the presence in input of the under-voltage signal and for consequently outputting the control signals 253.

The electronic means 200 of FIG. 5 can cause the displacement of the movable member 101 of the shunt release 100 from the retracted position to the released position, based on the detection of the shunt trip command 250 or of the under-voltage condition, and at least a command signal 255 specifying the return of the movable member 101 from a released position to a retracted position can be sent to the controller 202, for example through the communication means 206. Upon receiving such command signal 255 the controller 202 outputs one or more control signals (globally indicated in FIG. 5 with numeral reference 256) which are sent to and control the driving circuit 201 to cause the generation of the second current $I_2$ into the winding 120.

The electronic means 200 of the shunt release 100 implementing at least the under-voltage intervention according to an exemplary embodiment of the present disclosure includes one or more back-up capacitors 207 storing the energy specified to electrically drive the winding 120 of the associated shunt release 100 for generating the first magnetic force $F_1$ upon the detection of the under-voltage condition. Indeed, at the occurrence of the under-voltage condition the power line 205 falls and the associated power supply input circuit 204 cannot suitably supply the driving circuit 201 to cause the intervention of the shunt release 100 for opening the circuit breaker 1.

As shown in FIG. 5, a back-up capacitor 207 can be provided in the supply path from the power supply input circuit 204 to the driving circuit 201, so that when the undervoltage condition occurs and the controller 202 sends the control signals 253 to the driving circuit 201, such driving circuit 201 can operate according to the received signals 253 using the energy stored in the back-up capacitor 207.

According to an exemplary embodiment of the present disclosure, the electronic means 200 are advantageously configurable by an operator, for example through the communication means 206, for provisionally disabling the electrically driving of the winding 120 of the associated shunt release 100 upon the detection of the under-voltage condition. In this way, the opening and/or locking of the circuit breaker 1 is disabled by means of the shunt release 100, upon the occurrence of the under-voltage condition.

For example, the exemplary controller 202 shown in FIG. 5 can include one or more registers 208 storing a value indicative of the enabling or the disabling of the shunt release 100 intervention on the operating mechanism 10 due to the occurrence of the under-voltage condition. Upon detection of the under-voltage condition, the software instructions executed by the controller 202 cause the checking of the enabling or disabling value stored in the register 208.

The value stored in the register 208 is changed according to one or more enabling/disabling commands sent to the controller 202 by an operator. In the exemplary embodiment of FIG. 5 the enabling/disabling commands (globally indicated with reference numeral 254) can be sent to the controller 202, for example to a corresponding input port of the controller 202 such as through the communication means 106. In accordance with another exemplary embodiment, the controller 202 can be operatively connected to dip switches accessible by the operator at the outside of the circuit breaker 1; each dip switch being associated to a corresponding enabling or disabling value so as the actuation of the dip switch causes the storing of the associated value into the corresponding register 208.

According to an exemplary embodiment of the present disclosure, the shunt release 100 includes means arranged to count a delay time starting from the detection of the under-voltage condition by the electronic means 200. For example, the electronic means 200 can be operatively associated to such counting means and are configured for: electrically driving the winding 120 of the shunt release 100 to generate the first magnetic force $F_1$ when the delay time counting is completed; sensing during the counting if the under-voltage condition ceases, e.g., when the line voltage $V_L$ returns above the associated threshold; and resetting the counting upon sensing the ceasing of the under-voltage condition.

In an exemplary embodiment, the counting means can be configured as desired because the delay time to be counted is configurable; for example, the delay time can be set to a value in an exemplary range from 0 s up to 3 s.

In FIG. 5, a time counter 220, for example a digital time counter 220, can be arranged for counting a configurable delay time starting from the detection of the under-voltage condition by the electronic means 200. The controller 202 implements a programmable digital time counter by executing suitable software instructions (such digital counter is for simplicity schematically represented by a block indicated with the numeral reference 220). For example, the controller 202 can include at least a counting register 221 operatively associated to the time counter 220 and suitable for storing the number of counts which determines the desired duration of the delay time. The number of counts is configurable, e.g., programmable, by an operator, for example through the communication means 206. It is to be set forth that the number of counts can be set to a null value so that no delay time is counted.

According to another exemplary embodiment, the digital counter 220 can be an electronic unit separated from and operatively connected to the controller 202.

Still in accordance with yet another exemplary embodiment of the present disclosure, in setting the number of counts, the delay time may be programmed setting the clock frequency of the time counter 220, e.g., setting the time interval between two consequent counts.

The operating mechanism 10 of the circuit breaker 1 and the movable member 101 of the shunt release 100 can be operatively connected such that the movable member 101 blocks the operating mechanism 10 and avoids the closure of the circuit breaker 1. For example, the portion 107 of the movable member 101 in the released position (see FIG. 3) locks one or more parts of the operating mechanism 10 which, if released by the closure shunt release 7 schematically depicted in FIG. 2 or by a manual operation, would cause the closure of the circuit breaker 1.

Therefore, the movable member 101 in the released position can be suitable for locking the circuit breaker 1 in its open position; for allowing the closure of the open circuit breaker 1 the movable member 101 has to return from the released to the retracted position.

According to another exemplary embodiment of the present disclosure, intervention means (e.g., schematically depicted and indicated with the numeral reference 300 in FIG. 2) are provided in the circuit breaker 1, which are directly accessible for an operator of the circuit breaker 1 itself for being actuated by such operator. The intervention means 300 can be operatively associated to the shunt release 100 to generate, upon their actuation by the operator, a force $F_3$ acting on the movable member 101 held in the retracted position by the holding force $F_H$ (see FIG. 3).

The force $F_3$ is directed opposite with respect to the holding force $F_H$ and is suitable for causing the release of the compressed elastic means 108 which urge the movable member 101 towards the released position to lock the open circuit breaker 1.

According to an exemplary embodiment disclosed herein, the intervention means 300 can be mechanically operatively connected to the movable member 101 so as the generated a mechanical force $F_3$; such mechanical force $F_3$ can be transmitted directly from the actuated intervention means 300 to the movable member 101 or can be generated and transmitted by a suitable kinematic chain linking the intervention means 300 to the movable member 101. For example, the intervention means 300 may include a button 300 which, when pushed by the operator, causes the transmission of a mechanical force to the movable member 101, so to generate the force $F_3$.

According to another exemplary embodiment, the actuation of the intervention means 300, such as for example a push button 300, may cause the generation of an electrical command which is sent to the electronic means 200, e.g. to the controller 202 shown in FIG. 5; such command signal is suitable for causing the electrically driving of the winding 120 by the electronic means 200 to generate the first magnetic force $F_1$.

The electronic means 200 can be arranged for provisionally disabling the electrical driving of the winding 120 of the associated shunt release 100 to generate the second magnetic force $F_2$ upon the displacement of the movable member 101 to the released position caused by the actuation of the intervention means 300. In this way, the operator has caused the displacement of the movable member 101 from the retracted position to the released position through the intervention means 300, the electronic means 200 are disabled to cause the return of such movable member 101 in the retracted position, due to the receiving by remote of a command signal, such as the command signal 255 shown in FIG. 5. In this way, the locking of the open circuit breaker 1 is guaranteed during the operations of the operator.

For example, the operator may cause the generation of an electrical signal, pushing a suitable button or using a user interface (HMI); such generated signal is sent to the electronic means 200, e.g., to the controller 202 shown in FIG. 5, which are arranged for detecting the electrical signal and consequently disabling the control of the driving circuit 201 so as to generate the second current $I_2$ flowing through the winding 120.

The electronic means 200 are re-enabled to drive the winding 120 for generating the second magnetic force $F_2$ by a suitable intervention of the operator generating an enabling signal sent to the electronic means 200, for example through the user interface (HMI).

The operation of the circuit breaker 1 and the related shunt release 100 according to the present disclosure is described in the following description by making reference to the exemplary illustrated embodiments of FIGS. 2-5.

Starting from the situation in which the circuit breaker 1 is closed, the plunger 101 of the shunt release 100 is held in the retracted position by the holding force $F_H$ generated by the permanent magnet 109, as shown in FIG. 3.

Upon receiving and detecting the shunt trip command 250, the receiving circuit 203 of the electronic means 200 outputs the trip signal 251 which is sent to the corresponding input port of the controller 202.

The controller 202 detects the presence in input of the trip signal 251 and consequently outputs the control signals 252 which are sent to the driving circuit 201; such control signals 252 controls the driving circuit 201 to generate the first current $I_1$ into the winding 120 of the shunt release 100. The power supply specified from the driving circuit 101 to generate the first current $I_1$ is directly provided by the input power supply circuit 204.

The flowing of the first current $I_1$ through the winding 120 causes the generation of the first magnetic force $F_1$ acting on the plunger 101; the force given by the sum of the first magnetic force $F_1$ and the elastic force $F_E$ exerted by the compressed spring 108 is strong enough to overcome the holding force $F_H$ and start the displacement of the plunger 101 toward the released position.

The holding force $F_H$ is inversely proportional to the quadratic distance between the plunger 101 and the permanent magnet 109 and the first current $I_1$ is a current pulse having a duration time (e.g., 10 ms) set long enough to allow the overcoming of the decreasing holding force $F_H$ by the elastic force $F_E$. When the elastic force $F_E$ overcomes the decreasing holding force $F_H$ the spring 108 releases and urges the plunger 101 towards the released position shown in FIG. 4.

The displacement of the plunger 101 from the retracted position to the released position can also be caused by the detection of the under-voltage condition. The controller 202 continuously senses the voltage $V_S$ (indicative of the voltage line $V_L$) and monitors such sensed voltage $V_S$ to detect the undervoltage condition, e.g., when the sensed voltage $V_S$ falls below the associated predefined threshold stored in the controller 202.

Upon the detection of the under-voltage condition, the software instructions executed by the controller 202 cause the checking of the enabling or disabling value stored in the register 208. If the checked value is a disabling value, the controller 202 does not output the control signals 253 to the driving circuit 201 to generate the first current $I_1$ into the winding 120; therefore, no magnetic force generated by a current flowing through the winding 120 is acting on the plunger 101 which remains in the retracted position, even if the under-voltage condition has occurred.

If the checked value is an enabling value, the software instructions executed by the controller 202 causes the time counter 220 to start counting the delay time whose duration is determined by the configurable number of counts stored in the counting register 221.

The software instructions executed by the controller 202 then cause the sensing, during the delay time counting, of the under-voltage condition ceasing. If the under-voltage condition persists during the overall delay time counting, the controller 202 outputs the control signals 253 which are sent to and control the driving circuit 201; such control signals 253 controls the driving circuit 201 to generate the first current $I_1$ into the winding 120 and, therefore, to generate the first magnetic force $F_1$ acting on the plunger 101.

The power supply specified from the driving circuit 101 to generate the first current $I_1$ upon the occurrence of the under-voltage condition cannot be suitably provided by the input power supply circuit 204 due to the decrease (e.g., fall) in voltage of the associated power line 205. Such specified power is provided by the energy previously stored in the buck-up capacitor 207 by the input power supply circuit 204.

If the under-voltage condition ceases during the delay time counting, the counter is reset and no control signals 353 are output by the controller 202; in this manner, spurious or momentary decreases in the line voltage $V_L$ do not cause the intervention of the electronic means 200 to cause the displacement of the plunger 101 from the retracted position to the released position.

When the command signal 255 is sent to the controller 202, specifying the return of the plunger 101 from the released position to the retracted position, the controller 202 outputs the control signals 256 which are sent to and control the driving circuit 201 to generate the second current $I_2$ in the winding 120. The second current $I_2$ generates the second magnetic force $F_2$ having the same direction of the holding force $F_H$. The magnetic force being suitable for displacing the plunger 101 from the released position to the retracted position and compressing the spring 108 by means of such displacement.

For safety reasons, the closure operation of the open circuit breaker 1 should be blocked while an operator is performing certain actions on the circuit breaker 1, for example during the extraction of the circuit breaker 1 from the corresponding switchgear, or on one or more parts of the electrical circuit into which the circuit breaker 1 itself is installed.

Considering the starting situation in which the circuit breaker 1 is open, the operator actuates the intervention means 300 to generate the force $F_3$ acting on the armature 101 held in the retracted position. The force $F_3$ is directed opposite with respect to the holding force $F_H$ and causes the release of the compressed spring 108 which urges the plunger 101 towards the released position. The portion 107 of the plunger 101 in the released position locks one or more parts of the operating mechanism 10 which, if released by the closure shunt release 7 or by a manual operation, would cause the closure of the circuit breaker 1 during the actions of the operator.

Because until the plunger 101 rests in the released position, the closure of the circuit breaker 1 cannot be performed, the operator also disables the controller 202 to output the control signals 256 toward the driving circuit 201. In this way, even if the command signal 255 is sent by remote to the controller 202, requesting the return of the plunger 101 from the released position to the retracted position, the controller 202 does not consequently control the driving circuit 201 and the plunger 101 rests in the released position guaranteeing the locking of the open circuit breaker 1.

After performing the specified operations, the operator re-enables the controller 202 to control the driving circuit 101 for generating the second current $I_2$ flowing through the winding 120 of the shunt release 100.

In practice, it has been seen how the circuit breaker 1 according to the present disclosure allows achieving the intended object offering some improvements over known solutions.

In contrast to known under-voltage shunt releases, such as the under-voltage shunt release 6 of the circuit breaker 500 in FIG. 1, the exemplary movable member 101 in the shunt release 100 of circuit breaker 1 can be held in the retracted position only by the holding force $F_H$ generated by the permanent magnet 109, without consumption of electrical power. Therefore, the consumption of power and the heating inside the shunt release 100 and the circuit breaker 1 are reduced; For example, the power devices and/or components of the electronic means 200 associated to the shunt release 100, such as, the power input circuit 204 and the driving circuit 201 shown in FIG. 5, do not operate to hold the movable member 101 in the retracted position, therefore increasing their life time.

In further contrast to known opening shunt releases, such as the opening shunt release 5 of the circuit breaker 500 in FIG. 1, in the shunt release 100 of the circuit breaker 1 about all of the energy specified to displace its movable member 101 from the retracted position to the released position is stored in the elastic means 108 compressed by the movable member 101 held in the retracted position by the holding force $F_H$. Only a current pulse $I_1$ with short time duration (e.g., 10 ms) is called on to neutralize the effect of the permanent magnet 109 and release the elastic means 108. Therefore, the shunt release 100 specifies a very low electrical power consumption to displace the movable member 101 from the retracted position to the released position, and accordingly the associated electronic means 200 can operate in a low power consumption way.

Exemplary embodiments of the present disclosure providing a shunt release 100 and the associated electronic means 200 are suitable for implementing the opening and/or locking of the circuit breaker 1 due to both the detection of a shunt trip command 250 and the detection of the under-voltage condition.

Because the displacement of the movable member 101 from the retracted position to the released position is caused by the short time current pulse $I_1$, the intervention of the shunt release 100 on the operating mechanism 10 to open and/or lock the circuit breaker 1 upon request is very quick and reliable.

Further, only a small amount of energy should be stored in suitable means for generating the short time current pulse $I_1$ upon the occurrence of the under-voltage condition; for example, the buck-up capacitor 107 stores a small amount of energy for supply the driving circuit 201 and accordingly is dimensioned as a small electronic device which can be easily integrated or mounted on an electronic board.

The electronic means 200 associated to the shunt release 100 are also suitable for implementing in an easily and configurable way additional functionalities, such as functionalities related to the intervention of the shunt release 100 upon the occurrence of the under-voltage condition. For example, the intervention of the shunt release 100 on the operating mechanism 10 of the circuit breaker 1 upon the detection of the under-voltage configuration may be delayed (in a configurable way) or may be provisionally disabled through suitable software routines and/or instructions executed by electronic means 200.

Because the movable member 101 of the shunt release 100 according to exemplary embodiments of the present disclosure is held in the retracted position during the applied delay time only by means of the holding force $F_H$ generated by the permanent magnet 109, no large and expensive energy storage means, such as capacitors, have to be associated to the shunt release 100 for providing the energy specified to hold the movable member 101 in the retracted position during the delay time. Further, the delay time can be set to high values, for example up to 10 s, according to specific conditions and applications.

The shunt release 100 is advantageously connected to the intervention means 300 which provides a suitable interface for an operator to cause the intervention of the shunt release 10 on the operating mechanism 10 of the circuit breaker 1, to lock the circuit breaker 1 itself in the open position.

Therefore, a single shunt release 100 can advantageously replace in the circuit breaker 1 according to the present disclosure one or more of the following shunt releases and/or accessories which are provided in the circuit breaker 500 of FIG. 1, such as the shunt opening release 5 (and the redundant shunt opening release, if present), the under-voltage shunt release 6, the delaying devices 9 and the override mechanism 80 associated to such under-voltage shunt release 6, and the locking magnet 8.

Hence, the use in the circuit breaker 1 of the shunt release 100 provides a reduction of devices and/or accessories, which implies at least: reducing of power dissipation, reduction of spaces occupied, reduction of cabling and connections, reduction of costs, increase of functionalities integration, and increase in reliability.

Such results are achieved thanks to a solution which in principle makes the circuit breaker 1 according to the present disclosure easy to be used in connection with switchgear.

Moreover, all parts/components can be replaced with other technically equivalent elements; in practice, the type of materials, and the dimensions, can be selected as desired and according to the state of the art.

For example, more then one permanent magnet 109 may be used to generate the holding force $F_H$ acting on the movable member 101.

The components of the electronic means 200 may be integrated or mounted on one or more electronic boards connected each other; the electronic board(s) can be placed into the shunt release 100 or may be placed in any part of the circuit breaker 1.

While in an exemplary embodiment the controller 202 has been indicated to be a microprocessor, the controller 202 can also be for example a microcomputer, a minicomputer, a digital signal processor (DSP), an optical computer, a complex instruction set computer, an application specific integrated circuit, a reduced instruction set computer, an analog computer, a digital computer, a solid-state computer, a single-board computer, or a combination of any of theses.

Further, Instructions, data, signals, and parameters can be delivered to the controller 202 via non-transitory electronic data carts, manual selection and control, electromagnetic radiation, communication buses, and through any suitable non-transitory electronic or electrical transfer.

It will therefore be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A mechanically operated switching device comprising:

at least one movable contact configured to be coupled to and separated from a corresponding fixed contact;

an operating mechanism configured for coupling and separating said movable contact to and from the corresponding fixed contact, wherein said operating mechanism includes first elastic means for, upon release, providing energy to separate said movable contact from the corresponding fixed contact; and at least one shunt release having:

a moveable member disposed between a first stable position and a second stable position, wherein the movement from the first stable position to the second stable position causes the operative interaction between said movable member and one or more parts of the operating mechanism to release said first elastic means;

second elastic means which are connected to said movable member;

at least a permanent magnet generating a holding force for holding the movable member in the first position, wherein the movable member held in the first stable position is configured for compressing said second elastic means;

a single electrical winding which is connected to the movable member and to electronic means, wherein said electronic means are configured for electrically driving the winding to generate a first magnetic force acting on the movable member held in the first stable position, said first magnetic force releases the compressed second elastic means to urge the movable member towards the second stable position; and intervention means which are accessible by an operator of the switching device for being actuated by such operator, said intervention means being connected to said movable member of the shunt release to generate, when said intervention means are actuated by the operator, a force acting on the movable member held in the first stable position to cause a release of the compressed second elastic means, wherein said operating mechanism and the movable member of the shunt release in the second stable position are operatively connected such that the movable member blocksthe operating mechanism and prevents coupling between said movable and fixed contacts, wherein said electronic means are configured for electrically driving said single electrical winding to generate a second magnetic force acting on the movable member in the second stable position, said second magnetic force for displacing the movable member from the second stable position to the first stable position.

2. The switching device according to claim 1 wherein said electronic means include a driving circuit electrically connected to said single an electrical winding and configured for generating:

a first current flowing through said winding to generate said first magnetic force; and a second current flowing through said winding in an opposed direction with respect to said first current to generate said second magnetic force.

3. The switching device according to claim 1, wherein said electronic means are configured for receiving and detecting at least a shunt trip command and for driving said single electrical winding to generate said firstmagnetic force upon the detection of said shunt trip command.

4. The switching device according to claim 1, wherein said electronic means are configured for detecting an undervoltage conditiondetermined by a line voltage associated with said switching device falling below a predetermined threshold, said electronic means being configured for driving said single electrical winding to generate said first magnetic force upon the detection ofthe under-voltage condition.

5. The switching device according to claim 4, wherein said electronic means includes at least one buck-up capacitor storing energy for electrically driving said single electrical winding upon the detection of saidunder-voltage condition.

6. The switching device according to claim 4, wherein said electronic means are configurable for disabling a function of electrically driving said single electrical winding upon the detection of the under-voltage condition.

7. The switching device according to claim 4, wherein said shunt release includes counting means arranged to count a delay time starting from the detection of the under-voltage condition, wherein the electronic means are operatively associated with said counting means and are configured for:

electrically driving said at least one electrical winding to generate said first magnetic force when said counting is completed;

sensing during said counting if the under-voltage condition ceases; and resetting the counting upon sensing the ceasing of the under-voltage condition.

8. The switching device according to claim 7, wherein said delay time is configurable.

9. The switching device according to claim 1, wherein said intervention means are mechanically connected to said movable member, and wherein said force generated by the actuation of the intervention means is a mechanical force.

10. The switching device according to claim 1, wherein the electronic means are arranged to disable an operation to electrically drive said single electrical winding for generating said second magnetic force upon the displacement of the movable member to the second stable position caused by the actuation of said intervention means.

11. A switchgear comprising at least one switching device according to claim 1.

12. A mechanically operated switching device comprising:

at least one movable contact configured to be coupled to and separated from a corresponding fixed contact;

an operating mechanism configured for coupling and separating said movable contact to and from the corresponding fixed contact, wherein said operating mechanism includes first elastic means for, upon release, providing energy to separate said movable contact from the corresponding fixed contact; and at least one shunt release having:

a moveable member disposed between a first stable position and a second stable position, wherein the movement from the first stable position to the second stable position causes the operative interaction between said movable member and one or more parts of the operating mechanism to release said first elastic means;

second elastic means which are connected to said movable member;

at least a permanent magnet generating a holding force for holding the movable member in the first position, wherein the movable member held in the first stable position is configured for compressing said second elastic means; and a single electrical winding which is connected to the movable member and to electronic means, wherein said electronic means are configured for electrically driving the winding to generate a first magnetic force acting on the movable member held in the first stable position, said first magnetic force releases the compressed second elastic means to urge the movable member towards the second stable position wherein said electronic means are configured for electrically driving said single electrical winding to generate a second magnetic force acting on the movable member in the second stable position, said second magnetic force for displacing the movable member from the second stable position to the first stable position;

wherein the second elastic means of the at least one shunt release is disposed within an interior of a case of the at least one shunt release and contacts the moveable member within the interior of the case, and wherein the case comprises a front wall, a rear wall, and a lateral wall extending between the front wall and the rear wall, and the rear wall, the permanent magnet and the second elastic means being arranged such that the permanent magnet is disposed between the rear wall and the second elastic means and the second elastic means is disposed between the permanent magnet and the moveable member.

13. The switching device according to claim 12 wherein said electronic means include a driving circuit electrically connected to said single an electrical winding and configured for generating:

a first current flowing through said winding to generate said first magnetic force; and a second current flowing through said winding in an opposed direction with respect to said first current to generate said second magnetic force.

14. The switching device according to claim 12, wherein said electronic means are configured for receiving and detecting at least a shunt trip command and for driving said single electrical winding to generate said firstmagnetic force upon the detection of said shunt trip command.

15. The switching device according to claim 12, wherein said electronic means are configured for detecting an under-voltage conditiondetermined by a line voltage associated with said switching device falling below a predetermined threshold, said electronic means being configured for driving said single electrical winding to generate said first magnetic force upon the detection ofthe under-voltage condition.

16. The switching device according to claim 15, wherein said electronic means includes at least one buck-up capacitor storing energy for electrically driving said single electrical winding upon the detection of saidunder-voltage condition.

17. The switching device according to claim 15, wherein said electronic means are configurable for disabling a function of electrically driving said single electrical winding upon the detection of the under-voltage condition.

18. The switching device according to claim 15, wherein said shunt release includes counting means arranged to count a delay time starting from the detection of the under-voltage condition, wherein the electronic means are operatively associated with said counting means and are configured for:

electrically driving said at least one electrical winding to generate said first magnetic force when said counting is completed;

sensing during said counting if the under-voltage condition ceases; and resetting the counting upon sensing the ceasing of the under-voltage condition.

19. The switching device according to claim 12, wherein said operating mechanism and the movable member of the shunt release in the second stable position are operatively connected such that the movable member blocksthe operating mechanism and prevents coupling between said movable and fixed contacts.

20. The switching device according to claim 12 comprising:

intervention means which are accessible by an operator of the switching device for being actuated by such operator, said intervention means being connected to said movable member of the shunt release to generate, when said intervention means are actuated by the operator, a force acting on the movable member held in the first stable position to cause a release of the compressed second elastic means.

* * * * *